United States Patent [19]

Woodcock

[11] Patent Number: 5,050,256

[45] Date of Patent: Sep. 24, 1991

[54] ALLERGEN PROOF BEDDING SYSTEM WITH COVER PERMEABLE TO WATER VAPOR

[75] Inventor: Ashley Woodcock, Hale, England

[73] Assignee: Slumberland PLC, Greenfield, England

[21] Appl. No.: 530,210

[22] Filed: May 30, 1990

Related U.S. Application Data

[63] Continuation of Ser. No. 289,541, Dec. 23, 1988, abandoned.

[30] Foreign Application Priority Data

Dec. 29, 1987 [GB] United Kingdom ..... 8730252

[51] Int. Cl.[5] ..... A47C 27/00; A47G 9/00

[52] U.S. Cl. ..... 5/448; 5/470; 5/482; 5/490; 5/501; 428/264; 428/265; 428/304.4; 428/423.1; 428/425.1; 428/913; 428/290

[58] Field of Search ..... 5/482, 490, 495, 470, 5/448, 501, 502; 428/423.1, 425.1, 264, 265, 304.4, 913, 290

[56] References Cited

U.S. PATENT DOCUMENTS

| | | | |
|---|---|---|---|
| 1,261,314 | 4/1918 | Stoddard | 5/501 |
| 3,822,425 | 7/1974 | Scales | 5/453 |
| 4,508,775 | 4/1985 | Adiletta | 5/483 |
| 4,700,418 | 10/1987 | Ritter | 5/449 |

FOREIGN PATENT DOCUMENTS

| | | | |
|---|---|---|---|
| 92869 | 9/1958 | Norway | 5/501 |
| 2012159A | 7/1979 | United Kingdom | 5/482 |

OTHER PUBLICATIONS

"Allergen Proof Encasings" a brochure from AEP, Inc. 1450 E. 363rd St., Eastlake, Ohio 44094–1983.

"Allergy Control Products "-Brochure from ACP Co. 89 Danbury Rd., P.O. Box 793, Ridgefield, Conn. 06877–1984.

*Primary Examiner*—Alexander Grosz

*Attorney, Agent, or Firm*—Charles E. Baxley

[57] ABSTRACT

A bedding system for use where mite-allergy is a problem causing e.g. asthma comprises a permeable mite barrier such as microporous or vapor permeable coated fabric which can be used as a mattress cover or ticking, pillow and duvet covers.

3 Claims, 1 Drawing Sheet

ALLERGEN PROOF BEDDING SYSTEM WITH COVER PERMEABLE TO WATER VAPOR

This is a continuation of application Ser. No. 289,541, filed Dec. 23, 1988, now abandoned.

BACKGROUND OF THE INVENTION

This invention relates to bedding systems.

A substantial proportion of the population suffers from asthmatic allergic reaction to mites. Mites reside in large numbers in the "upholstery" of mattresses, pillows, duvets and the like, emerging into the warmth when the bed is occupied.

It has been established that, by controlling mites, asthmatics, skin-test positive to the House Dust Mite *Dermatophagoides pteronyssinus*, showed significant improvement. Mite control was effected by an initial kill by liquid nitrogen.

Unfortunately, liquid nitrogen treatment is not a practical proposition for mite control except in the laboratory.

Clearly, other methods of killing the mites could be used, or establishing conditions in the upholstery in which the mites could not survive. The use of chemical controls, however, has problems in that the controls themselves could have harmful effects, and they might not have the necessary permanence for bedding, which is used on a long term basis and which may need at least occasional laundering.

The present invention provides method for mite control in bedding not subject of these disadvantages.

BRIEF DISCLOSURE OF THE INVENTION

The invention comprises a bedding system in which the or a substantial part of the upholstery is enclosed in a permeable mite barrier.

This will effectively prevent mites entering the upholstery and also prevent any mites in the upholstery emerging to effect an occupant.

It is important that the mite barrier is permeable, however, in order to avoid discomfort and, in long-term occupation as with invalids and in hospitals, bedsores.

Ideally, if the mite barrier has pores, it should have a pore size generally less than 10 microns. It is apparent that anything smaller causes no allergic reaction.

A microporous mite barrier will, of course, be air-permeable. There are, however, coated fabrics which are not porous and not therefore air permeable, but which are vapour permeable, while being impenetrable to free water. One such fabric is commercially available as a polyurethane system known as Baxenden Witcoflex 971/973. Others are described in the literature such, for example, as British Patent Specification No. 1,341,325.

Such fabrics have already been used in bedding systems—see, for example, British Patent Specification No. 1,596,157, which describes a mattress cover of a "chemically/physico-chemically porous" material such as that disclosed in Specification No. 1,341,325. Evidently, the fabrics have been intended for increased comfort in use by permitting body-generated water vapour to be dispersed through the fabric whilst also acting to prevent free water from entering the mattress interior, and this is clearly of value in hospitals and in cases wherein incontinence is a problem, and for the control of bedsores.

In GB-2,105,548A, a polyurethane-coated warp knitted nylon mattress cover is made fire resistant.

Such fabrics can also be used in bedding systems according to the present invention and will clearly have the required comfort properties of the prior art bedding sytsems and, where appropriate, the first resistant property.

It has recently been proposed to enclose mattresses, pillows and box springs in dust-proof encasings made from a polyester-cotton fabric laminated with a dust-proof coating, the latter being arranged to be on the inside of the encasing. Such dust-proof coating, however, has not been breathable or permeable and so has solved the allergic reaction problem only at the expense of comfort, which has militated against its long term use and its use in hospitals.

The prior art proposals to use permeable fabrics have not, on the other hand, been effective for the control of mites because it has not been recognised that a substantially total barrier is required, whereas the prior art permeable fabric "comfort" proposals have deemed it necessary somehow to eliminate the moisture that has been transferred through the permeable fabric and so that bottom of the mattress has been left open. Moreover, these prior art "comfort" proposals have been essentially confined to the mattress, whereas mites tend to infest pillows and increasingly popular duvets.

If sleeping on an impermeable mattress or mattress cover is uncomfortable, a plastic pillow is even more so. An impermeable duvet is a risk because of the possibility of suffocation.

The permeable mite barrier of the invention can be used for the mattress ticking or as a mattress cover or as an enclosure within a mattress and may also be used as a pillow case or as an eiderdown or duvet cover.

In all cases, the mite barrier may comprise a material which is itself decorative so that it can form the top cover of the item concerned, or it may be covered with a conventional material for added comfort and/or decoration.

It is clealy better if the complete bedding system incorporates the mite barrier, but a substantial improvement would result even if merely the mattress were protected in this way.

BRIEF DESCRIPTION OF THE DRAWINGS

Embodiments of bedding systems according to the invention will now be described with reference to the accompanying drawings, in which.

DETAILED DISCLOSURE OF THE PREFERRED EMBODIMENTS

Figure 1:
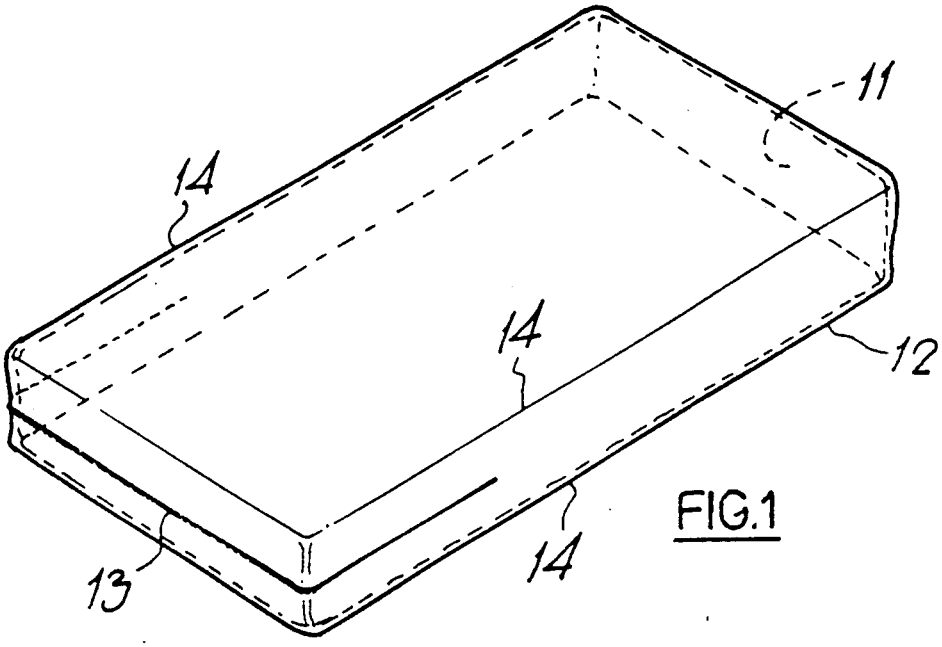
FIG. 1—is a perspective view of a mattress cover according to the invention.

The mattress 11 illustrated in FIG. 1 is conventional. It is covered completely, however, by a cover 12 with a minimal closure 13 in the form of a closely meshing sliding fastener. Seams 14 of the cover 12 are desirably made carefully leaving little or no perforation through which mites can pass and desirably sealed as by an additional polyurethane coating.

The material of the cover 12 is a Baxenden Witcoflex 971/973 type polyurethane coated closely woven nylon or polyester fabric. Such fabric has a permeability in the range 2,500–7,000 gms of water vapor/$m^2$/day and is available commercially from Coverplus (Coated Fabrics) Limited of Newton, Hyde, Cheshire, England.

The material may instead be used as the mattress ticking, of course, like consideration being given to the seams thereof and to any other penetration as of quilting or buttons. It is probably easier, however, in general, to make conventional mattresses and provide them with mite-proof covers where necessary.

The material will be coated on one face only and the coated face may be on the inside of the cover 12 or ticking.

Figure 2:
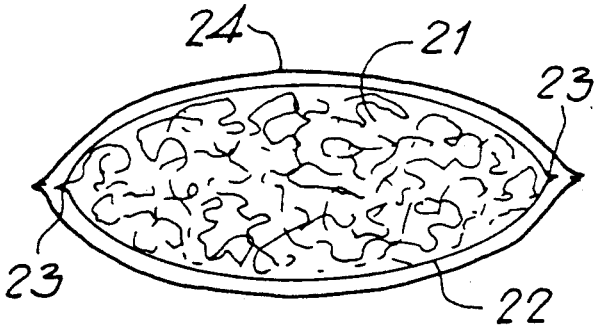
FIG. 2—is a diagrammatic cross-section through a duvet or pillow.

FIG. 2 illustrates a duvet/pillow system in which the foam or flock filling 21 is cased in a cover 22 of mite barrier material.

Again, the coated face may be on the inside. Seams 23 may be overlocked and coated with polyurethane. The duvet or pillow is, for use, enclosed in a regular duvet or pillow cover 24.

Figure 3:
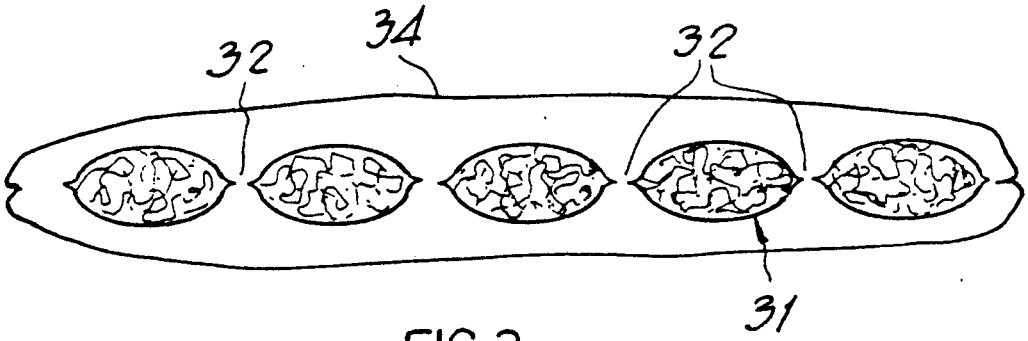
FIG. 3—is a diagrammatic cross-section through another duvet.

FIG. 3 illustrates a devet 31 which is capable of being used with or without a regular duvet cover 34 and is of quilted or buttoned construction. The quilting seams or button locations 32 are perforated through from face to face of the duvet without, however, opening to the inside thereof. Such an arrangement will avoid any risk that the coated fabric will cause suffocation in the manner of a plastic bag.

An advantage of the vapour permeable fabrics is that they can be laundered without washing water penetrating to the inside, so that flock, feathers and the like remain dry.

The fabrics can be decorative—printed or colored in the usual ways.

Coatings for uses where incontinence is not a problem can be lighter and the coated fabrics approximate more to uncoated fabrics in their handle, drape etc. Flameproofing can, of course, be incorporated.

I claim:

1. A bedding system comprising an item of bedding for the control of mite-induced allergy, said system having interior upholstery and cover means for said upholstery including permeable mite barrier material of coated fabric totally enclosing all of said upholstery and being permeable to water vapor in excess of 2,500 $g/m^2day$, said upholstery and cover means including top and bottom panels and side panels devoid of any apertures therein for the passage of fluid between inside and outside of the mattress, said material not having pores greater in size than 10 microns.

2. A system according to claim 1 wherein said cover means are removable.

3. A system according to claim 1 wherein said fabric is coated with one of Baxenden Witcoflex 971 and 973.

* * * * *